US012372321B2

(12) United States Patent
Dion et al.

(10) Patent No.: US 12,372,321 B2
(45) Date of Patent: Jul. 29, 2025

(54) CONVERSION KIT FOR REPLACING A BARREL ON A SERVICE WEAPON WITH A TRAINING BARREL TO FIRE REDUCED ENERGY TRAINING ROUNDS

(71) Applicant: General Dynamics Ordnance and Tactical Systems—Canada, Inc., Repentigny (CA)

(72) Inventors: Richard Dion, Saint-Cuthbert (CA); Erick Picard, l'assomption (CA)

(73) Assignee: GENERAL DYNAMICS ORDNANCE AND TACTICAL SYSTEMS—CANADA, INC., Repentigny (CA)

( * ) Notice: Subject to any disclaimer, the term of this patent is extended or adjusted under 35 U.S.C. 154(b) by 98 days.

(21) Appl. No.: 18/494,064

(22) Filed: Oct. 25, 2023

(65) Prior Publication Data

US 2024/0247903 A1 Jul. 25, 2024

Related U.S. Application Data

(60) Provisional application No. 63/381,475, filed on Oct. 28, 2022.

(51) Int. Cl.

| | |
|---|---|
| ***F41A 21/48*** | (2006.01) |
| ***F41A 21/34*** | (2006.01) |
| ***F41A 33/00*** | (2006.01) |

(52) U.S. Cl.

CPC ..... *F41A 33/00* (2013.01); *F41A 21/34* (2013.01); *F41A 21/487* (2013.01)

(58) Field of Classification Search

CPC ..... F41A 21/48; F41A 21/487; F41A 21/34; F41A 33/00

See application file for complete search history.

(56) References Cited

U.S. PATENT DOCUMENTS

| | | | | |
|---|---|---|---|---|
| 4,501,189 | A | 2/1985 | Rudolf et al. | |
| 4,510,843 | A * | 4/1985 | Rabatin | F41A 21/325 89/14.4 |
| 4,729,186 | A | 3/1988 | Rieger | |
| 5,983,773 | A | 11/1999 | Dionne | |
| 6,357,331 | B1 | 3/2002 | Dionne | |
| 6,385,891 | B1 * | 5/2002 | Rabatin | F41A 21/325 42/79 |

(Continued)

OTHER PUBLICATIONS

Simunition, Training for the real world, catalog, 2016, Product No. 5303330, www.simunition.com.

(Continued)

*Primary Examiner* — Jonathan C Weber
(74) *Attorney, Agent, or Firm* — Lorenz & Kopf, LLP

(57) ABSTRACT

A conversion kit for installation into weapon to replace the service barrel with a sub-caliber barrel for firing reduced energy training cartridges. The conversion kit includes a barrel sleeve, a barrel support and a collet disposed between in the barrel support for fixedly securing the barrel sleeve therein. The collet is disposed in a double tapered bore formed in the barrel support for fixedly securing the barrel sleeve at both ends of the collet into the barrel support. A flash hider, which has been removed from the service barrel, is threadably received in the barrel support and functions as a collet nut for clamping the collet onto the barrel sleeve.

20 Claims, 6 Drawing Sheets

(56) References Cited

U.S. PATENT DOCUMENTS

| | | | |
|---|---|---|---|
| 8,701,326 | B2 | 4/2014 | Zonshine |
| 8,931,198 | B2 | 1/2015 | Aalto |
| 9,057,576 | B2 | 6/2015 | Barrett et al. |
| 9,927,201 | B2 | 3/2018 | Penchuk |
| 10,254,071 | B2 | 4/2019 | Dionne |
| 10,982,923 | B2 | 4/2021 | Seghi et al. |
| 11,280,573 | B2 | 3/2022 | MacKey |
| 11,287,235 | B2 | 3/2022 | Lafortune |
| 2020/0124373 | A1 | 4/2020 | Juarez |

OTHER PUBLICATIONS

Simunition, Training for the real world, catalog, 2013, Product No. 5302580, www.simunition.com.
Simunition, Training for the real world, catalog, 2012, Product No. 5307570, www.simunition.com.

* cited by examiner

CONVERSION KIT FOR REPLACING A BARREL ON A SERVICE WEAPON WITH A TRAINING BARREL TO FIRE REDUCED ENERGY TRAINING ROUNDS

CROSS-REFERENCE TO RELATED APPLICATIONS

This application claims the benefit of U.S. Provisional Application No. 63/381,475, filed on Oct. 28, 2022. The entire disclosure of the above application is incorporated herein by reference.

TECHNICAL FIELD

The invention relates to the field of firearms and provisions for modifying a service weapon for training purposes. In particular, the invention relates to a conversion kit to replace the service barrel with a sub-caliber barrel for firing reduced energy training cartridges.

BACKGROUND

This section provides background information related to the present disclosure which is not necessarily prior art.

Significant resources are spent annually to train military forces and police departments in the use of their service weapons. One type of training employs low-energy cartridges designed to simulate service rounds for non-lethal training. An advantage of the low-energy training ammunition is that it has a shorter range and lower penetration capacity than standard ammunition. A weapon firing low-energy marking cartridges makes an effective close-range, force-on-force training system. This system enhances the realism and training value of interactive scenario tactical training because it allows trainees to use their service weapons in a representative manner for simulated exercises, e.g., counter-terrorism, close quarters combat, urban fighting, protection of dignitaries, trench clearing, and fighting in wooded areas.

Modifications to a service weapon are typically required to permit cycling of rounds while firing low-energy training ammunition. These modifications may include replacing the service barrel in a weapon with a sub-caliber barrel using a conversion kit. Conversion kits typically employ a clamping device affixed to the muzzle end of a barrel sleeve. These clamping devices add mass to the muzzle end of the weapon, thus altering its weight and balance. These conversion kits typically require the use of a tool to install and remove the clamping device, which may be easily lost or misplaced.

Accordingly, it is desirable to provide a conversion kit for replacing a service barrel in a weapon with a sub-caliber barrel to fire reduced energy training cartridges that does not significantly alter the weight or operations of a service weapon. In addition, it is desirable to provide a conversion kit for modifying a service weapon to fire reduced energy training cartridges that does not require any tools to make such modifications. Furthermore, other desirable features and characteristics of the present invention will become apparent from the subsequent detailed description of the invention and the appended claims, taken in conjunction with the accompanying drawings and this background of the invention.

SUMMARY

In one embodiment, the present disclosure provides a conversion kit for a weapon to replace a service barrel with a sub-caliber barrel for firing reduced energy training cartridges. The conversion kit includes a barrel support having a double tapered bore extending from a muzzle end of the barrel support and a cylindrical bore extending from a breech end of the barrel support and into the double tapered bore. The doubled tapered bore has a first cylindrical section, a second cylindrical section, a first tapered section between the first and second cylindrical sections and a second tapered section disposed at the end of the second cylindrical section opposite the first tapered section. The conversion kit further includes a collet having a gripping portion disposed in the first cylindrical section, a shoulder disposed in the first tapered section and a sleeve portion disposed in the second cylindrical section. A collet bore extends through the collet. The conversion kit also includes a barrel sleeve disposed through the cylindrical bore of the barrel support and through the collet bore. A collet nut is disposed in the first cylindrical portion of the tapered bore and is configured to engage the collet. The collet nut urges the shoulder toward the first tapered section thereby causing an inner diameter of the gripping portion to reduce and grip the barrel sleeve at a first clamping point. The collet nut also urges the sleeve portion into the second tapered section causing an inner diameter of the shoulder portion to reduce and grip the barrel sleeve at a second clamping point.

In another embodiment, the present disclosure provides a conversion kit for a weapon to replace a service barrel with a sub-caliber barrel for firing reduced energy training cartridges. The conversion kit includes a barrel support having a tapered bore extending from a muzzle end of the barrel support and a cylindrical bore extend from a breech end of the barrel support and into the double tapered bore. The tapered bore has a first cylindrical section, a second cylindrical section, and a first tapered section between the first and second cylindrical sections. The conversion kit further includes a collet having a shoulder disposed in the first cylindrical section, a gripping portion disposed in the first tapered section and a sleeve portion disposed in the second cylindrical section. A collet bore extends through the collet. The conversion kit also includes a barrel sleeve disposed through the cylindrical bore of the barrel support and through the collet bore. A collet nut is disposed in the first cylindrical portion of the tapered bore and is configured to engage the collet. The collet nut urges the shoulder toward the first tapered section thereby causing an inner diameter of the gripping portion to reduce and grip the barrel sleeve at a first clamping point.

BRIEF DESCRIPTION OF THE DRAWINGS

The drawings described herein are for illustrative purposes only of selected embodiments and not all possible implementations and are not intended to limit the scope of the present disclosure.

and

Figure 8:
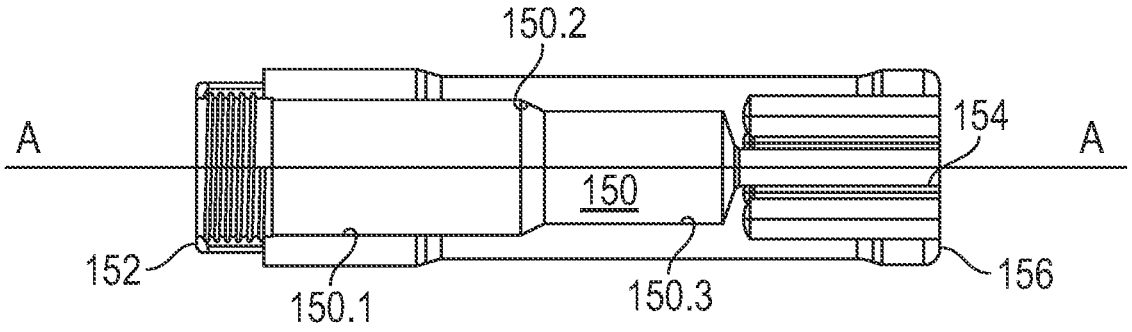

FIG. 8 is a longitudinal cross-section of a barrel support having a single tapered bore Corresponding reference numerals indicate corresponding parts throughout the several views of the drawings.

DETAILED DESCRIPTION

Example embodiments will now be described more fully with reference to the accompanying drawings. There is no intention to be limited by any principle presented in the preceding background or the following detailed description.

Figure 1:
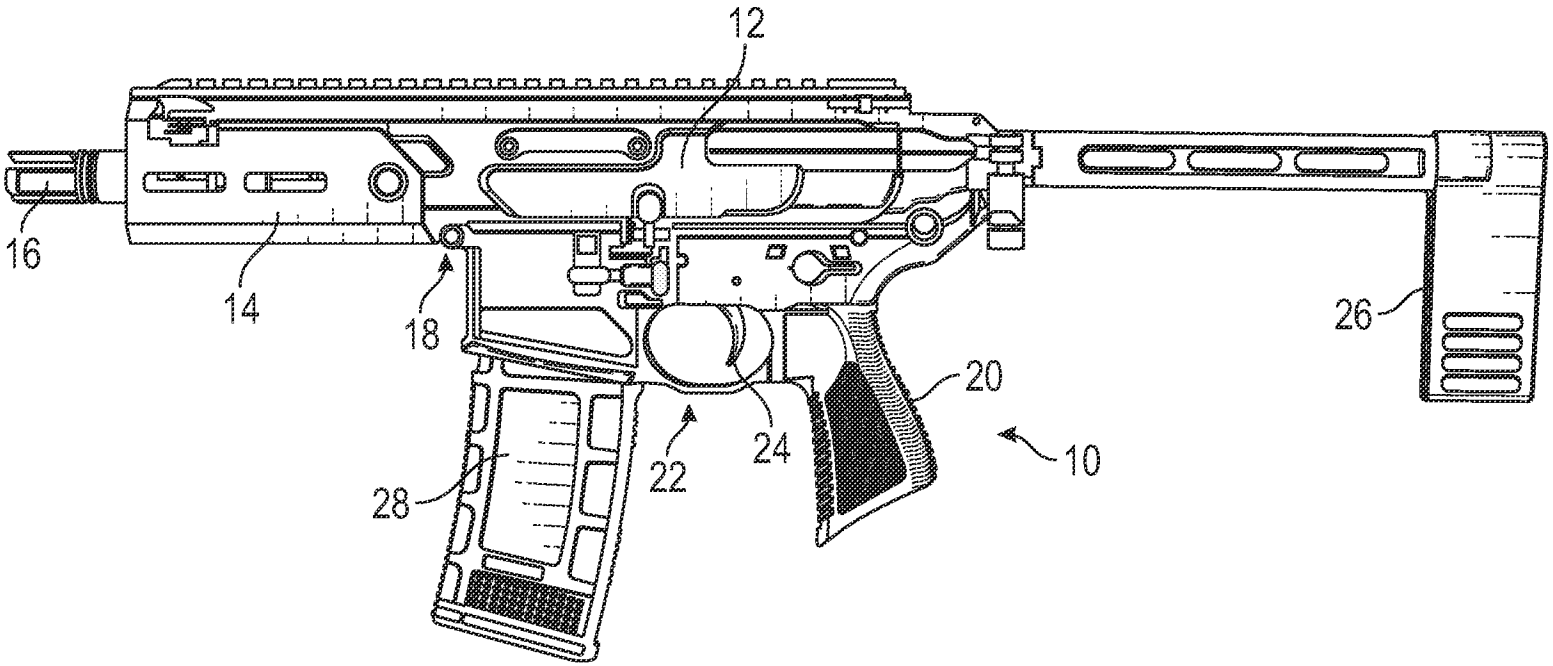
FIG. 1 shows a service weapon in the form of a submachine gun.

A weapon 10 shown in FIG. 1 includes a receiver 12, a hand guard 14 covering a service barrel 16, and a muzzle silencer 18 extending over the barrel 16 beneath the hand guard 14. The weapon 10 further includes a gun handle 20 with a trigger case 22 and a trigger 24, a shoulder rest 26, and a magazine 28. The weapon 10 illustrated in FIG. 1 is an exemplar weapon known as a SIG Sauer SIG556, that may be readily configured with a sub-caliber barrel to fire reduced energy training cartridges.

With reference now to FIGS. 2-5, a conversion kit 40 may be installed in the weapon 10 to replace the service barrel 16 with a barrel sleeve 42 for firing reduced energy training cartridges. The barrel sleeve 42 may have a reduced caliber relative to the service barrel (i.e., sub-caliber barrel sleeve) for accommodating training cartridges. Otherwise, the barrel sleeve 42 may be fabricated using a hardened steel with internal rifling similar to the service barrel 16. One skilled in the art should understand that the conversion kit 40 described and illustrated herein may be readily adapted for use with weapons other than weapon 10 without departing from the scope and spirit of the detailed description provided herein. The conversion kit 40 includes a barrel sleeve 42, a barrel support 44 and a collet 46 disposed in the barrel support 44 for receiving and fixedly securing the barrel sleeve 42 therein. A collet nut 48, in the form of a flash hider that has been removed from the service barrel 16, is threadably received in the barrel support 44 for clamping the collet 46 onto the barrel sleeve 42. One skilled in the art should appreciate that the conversion kit 40 may include a separate collet nut 48 in place of the threaded flash hider.

Figure 4:
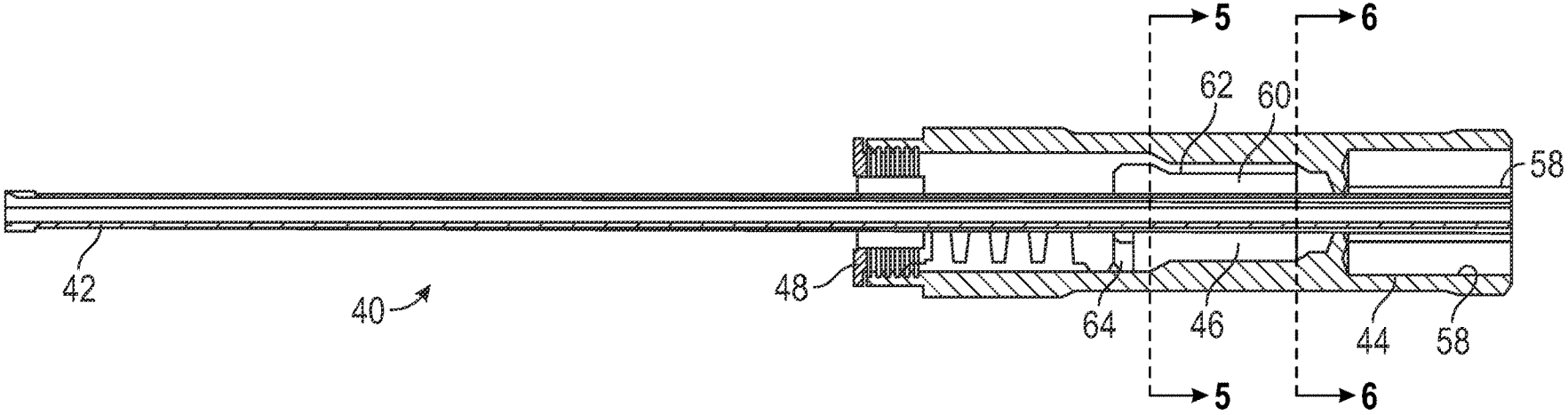
FIG. 4 is a longitudinal cross-section of the conversion kit in an assembled state.
Figure 7:
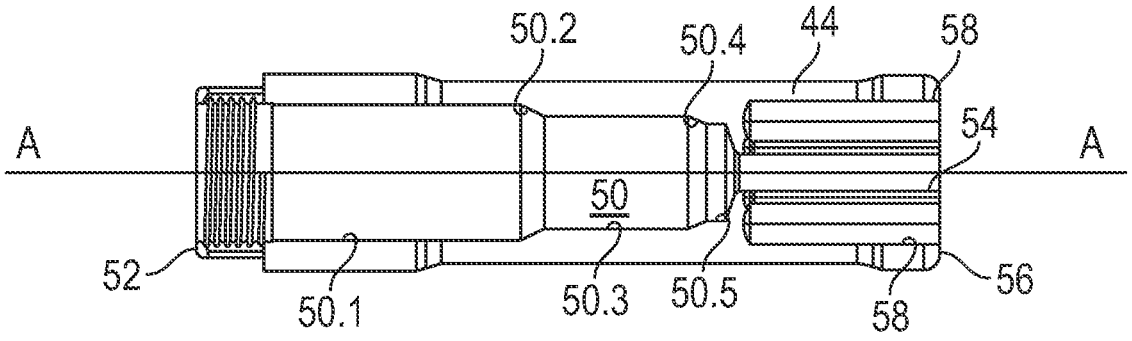
FIG. 7 is a longitudinal cross-section of a barrel support having a double tapered bore.

The barrel support 44 is generally cylindrical in shape and sized to replace the muzzle silencer 18 of the weapon 10. With the muzzle silencer 18 removed from the weapon 10, the barrel support 44 may be inserted into the hand guard 14 and secured to the weapon 10 in the same manner as the muzzle silencer 18. For example, exterior threads (not shown) on the collet nut 48 may be used to secure the conversion kit 40 to the receiver 12. As best seen in FIGS. 4 and 7, a double tapered blind bore 50 formed in the barrel support 44 functions as a spindle for receiving the collet 46. The blind bore 50 includes a first cylindrical section 50.1 having a first diameter D1 extending from the muzzle end 52 of the barrel support 44, a first tapered section 50.2 transitioning from the first cylindrical section 50.1 to a second cylindrical section 50.3 having a second diameter D2, a second tapered section 50.4 transitioned from the second cylindrical section 50.3 to a third cylindrical section 50.5 having a third diameter D3. As illustrated in FIG. 7, the diameter of the second cylindrical section 50.3 is less than the diameter of the first cylindrical section 50.1. Likewise, the diameter of the third cylindrical section 50.5 is less than the diameter of the second cylindrical section 50.3. A portion of the first cylindrical section 50.1 is threaded for receiving the collet nut 48. A cylindrical bore 54 extends from the breech end 56 of the barrel support 44 into the blind bore 50 and is configured to receive the barrel sleeve 42. A series of blind bores 58 may be formed in the breech end of the barrel support 44 for reducing the weight of the conversion kit 40 such that it closely corresponds to the weight of the service barrel 16 and muzzle silencer 18 removed from the weapon 10.

Figure 2:
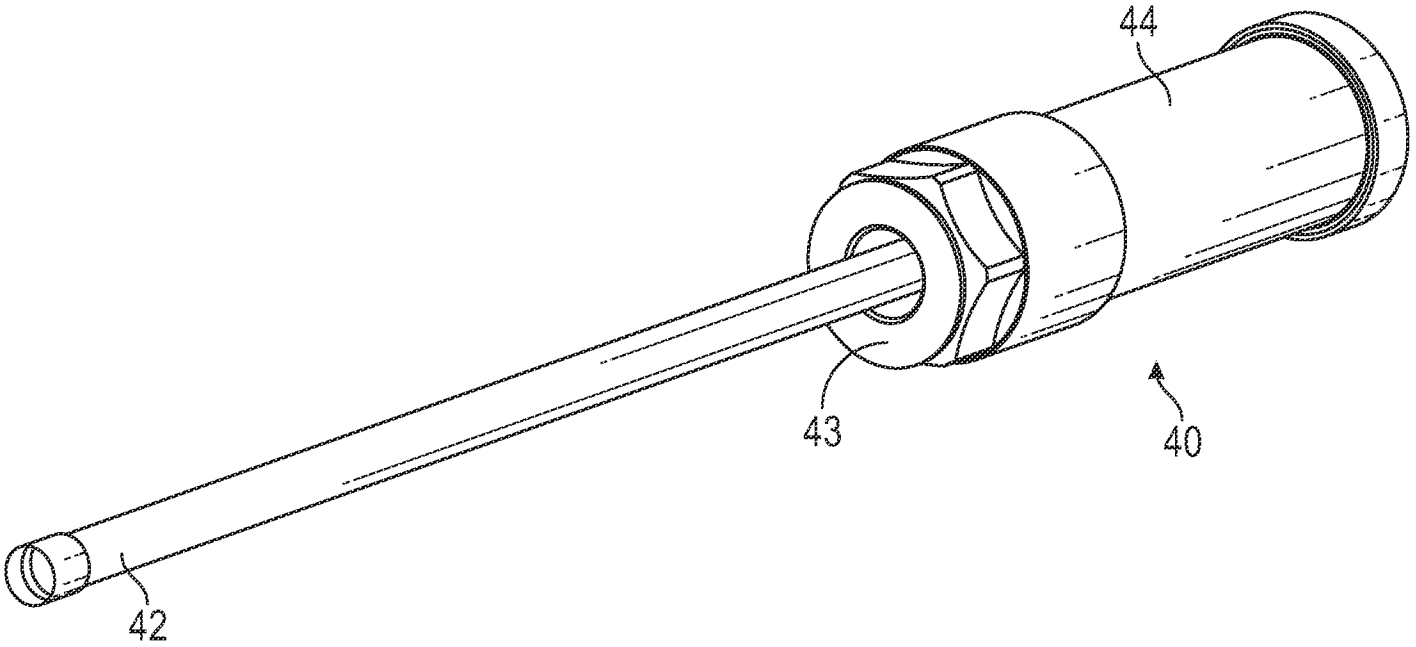
FIG. 2 show a perspective view of a conversion kit for firing reduced energy training cartridges with the service weapon.
Figure 5:
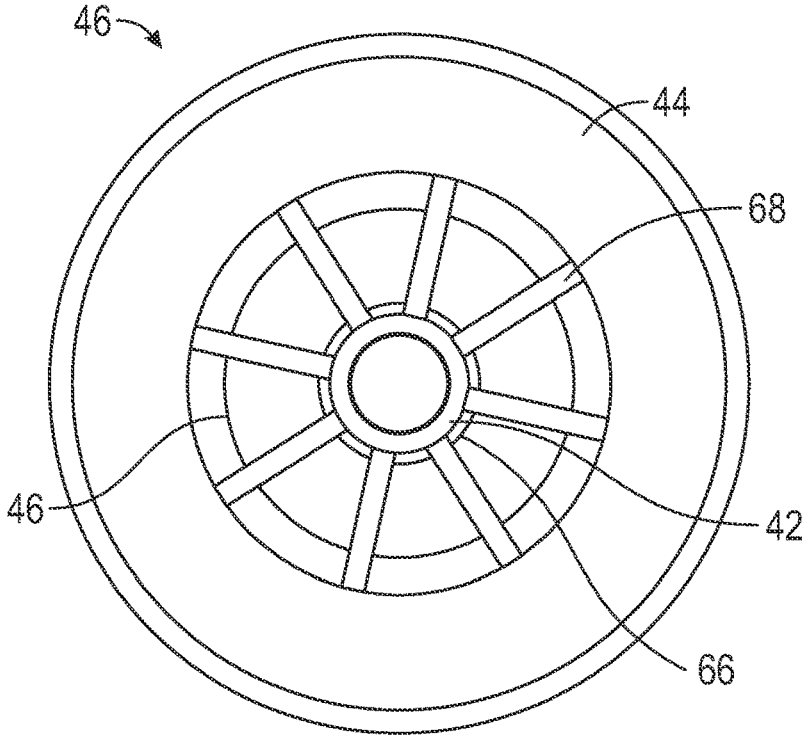
FIG. 5 is a lateral cross-section taken through V-V shown in FIG. 4.
Figure 6:
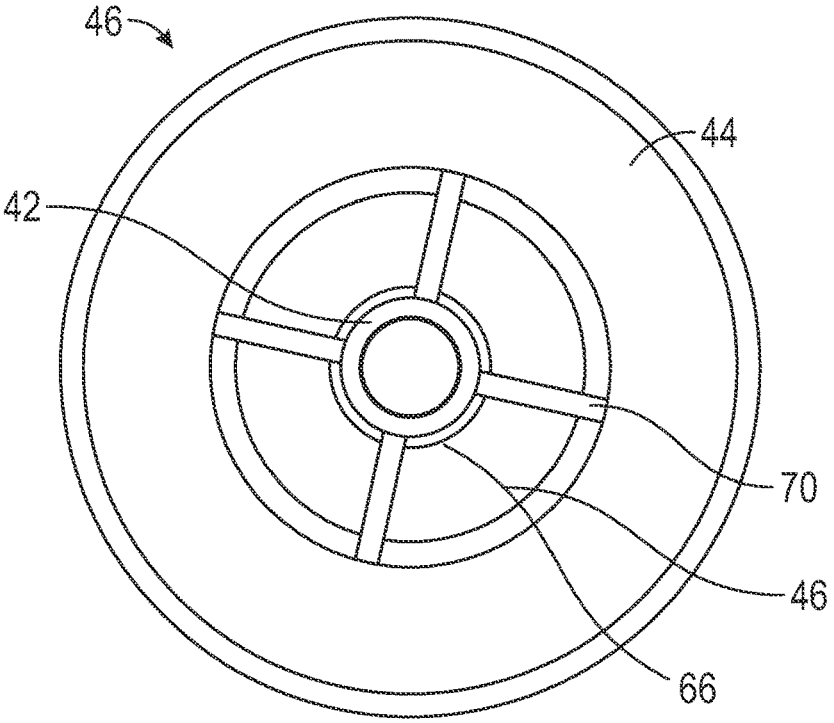
FIG. 6 is a lateral cross-section taken through VI-VI shown in FIG. 4.

With reference to FIGS. 2 and 5-6, the collet 46 includes a sleeve portion 60, a gripping portion 62 and a shoulder portion 64. A bore 66 extends through the collet 46 and is configured to receive the barrel sleeve 42. In operation, the collet 46 is placed into the blind bore 50 of the barrel support 44 until an end of the sleeve portion 60 abuts the second tapered section 50.4 and the gripping portion 62 abuts the first tapered section 50.2. The barrel sleeve 42 is inserted into the cylindrical bore 54 in the barrel support 44 and passes through the bore 66 in the collet 46 and extends out of the muzzle end 52 of the barrel support 44. The collet nut 48 is then threaded into the first cylindrical section 50.1 and tightened therein to secure the barrel sleeve 42 in the collet 46. As the collet nut 48 is tightened and engages the collet 46, the shoulder portion 64 is urged toward the first tapered section 50.2 thereby causing the inner diameter of the gripping portion 62 to reduce and grip the barrel sleeve 42 at a first clamping point. Likewise, the end of the sleeve portion 60 is urged into the second tapered section 50.4 causing the inner diameter of the sleeve portion 60 to reduce and grip the barrel sleeve 42 at a second clamping point. In this way, the double tapered blind bore 50 fixedly secures the barrel sleeve 42 at both ends of the collet 46 into the barrel support 44.

To remove the barrel sleeve 42 from the collet 46, the collet nut 48 is loosened from the barrel support 44, which causes the shoulder portion 64 to disengage the first tapered section 50.2 and the sleeve portion 60 to disengage the second tapered section 50.4 causing in the collet 46 to relax the clamping force on the barrel sleeve 42. The collet 46 is fabricated from resilient material, such as, for example, spring steel. Accordingly, when the collet nut 48 is loosened, the collet 46 substantially returns to its original position, thereby enabling the barrel sleeve 42 to be removed therefrom. Once the sleeve portion 60 and the gripping portion 62 are relaxed, the barrel sleeve 42 may be extracted from the collet 46 and, in turn, from the barrel support 44.

Figure 3:
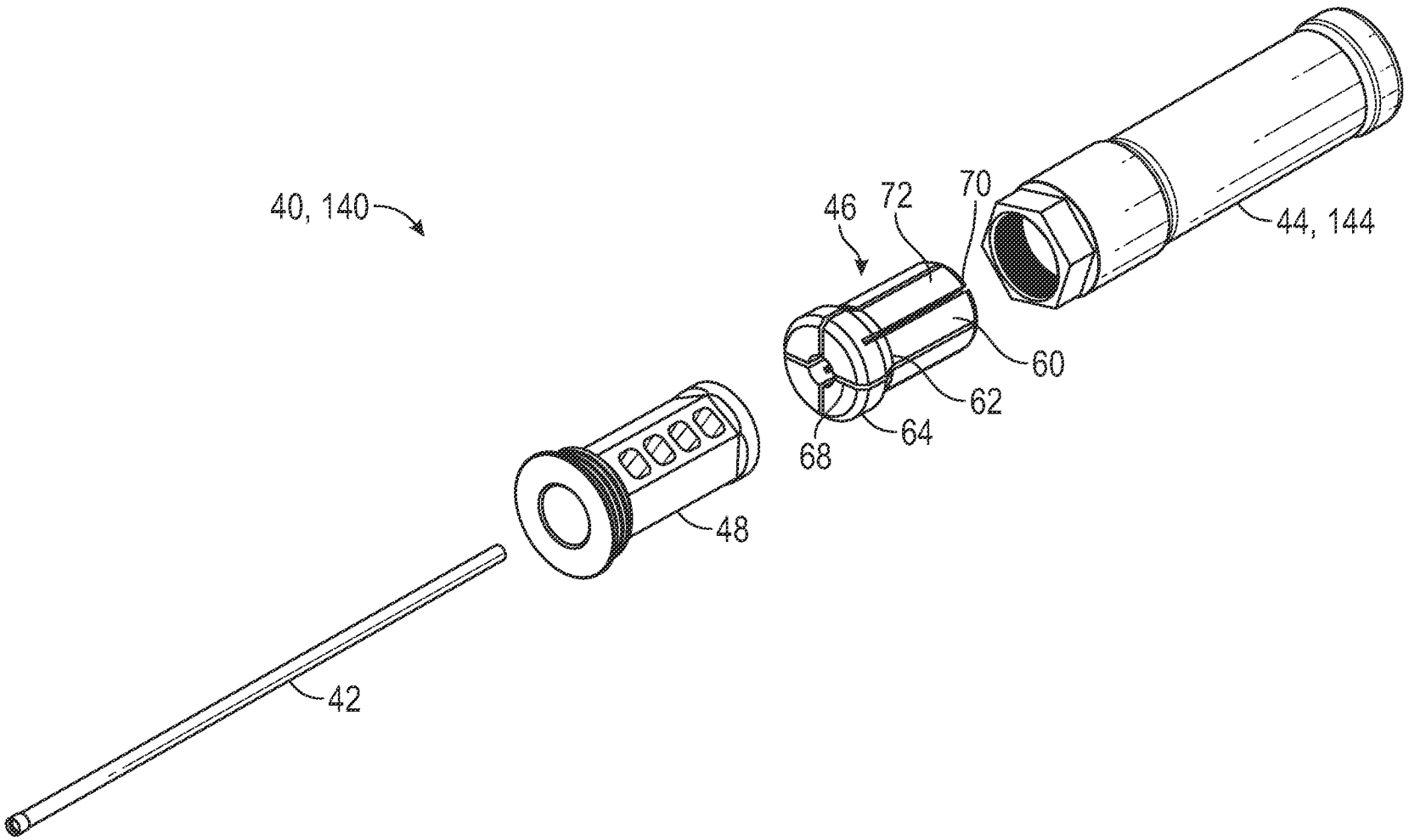
FIG. 3 shows the conversion kit of FIG. 2 in an expanded state.

As best seen in FIG. 3, the collet 46 includes four longitudinal slots 68 extending from the muzzle end of the collet 46. Likewise, the collet 46 includes four longitudinal slots 70 extending from the breech end of the collet 46. Slots 68, 70 defining a plurality of flutes 72 which are able to flex radially inward for applying a clamping force onto the barrel sleeve 42. Each flute 72 includes sections that form a part of the sleeve portion 60, the gripping portion 62 and the shoulder portion 64. So configured, the collet 46 is able to tighten a broader range of barrel sleeve diameters than with convention clamping devices. As a result, the dimensional tolerance of the barrel sleeve 42 can be increased, thereby reducing the manufacturing cost of the barrel sleeve, and decreasing the number of rejected barrel sleeves.

The following dimension are for a current design of the collet 46; however, it should be understood that such dimensions are exemplary and that other dimensions could alternatively be employed. The overall length of the example collet 46 may be approximately 42 mm, with the length of the sleeve portion 60 being approximately 28 mm. The length of the slots 68, 70 are approximately 40 mm and the length of the flutes 72 are approximately 29 mm, respectively. The shoulder portion 64 is located approximately 40 mm from the end of the sleeve portion 60. In the illustrated example, a taper angle of the shoulder portion 64 relative to a longitudinal axis A is approximately 45°, and a taper angle of the end of the sleeve portion 60 relative to the longitudinal axis A is approximately 24°. A taper angle of the first tapered section 50.2 relative to the longitudinal axis A is approximately 45° and a taper angle of the second tapered section 50.4 relative to the longitudinal axis A is approximately 24°. One skilled in the art should appreciate that the dimensions of the collet 46 may vary depending on the geometry and dimensions of the other components of the conversion kit 40, 140 as well as the geometry and dimensions of the corresponding service components of the weapon (e.g., housing, hand guard, service barrel, silencer, etc.) to be configured with the conversion kit.

FIG. 8 illustrates an alternate embodiment of a conversion kit 140 in which the barrel sleeve is configured with a tapered bore instead of a double tapered bore. The remaining components of the conversion kit 140 are the same as the conversion kit 40 described above with reference to FIGS. 2-7. Conversion kit 140 includes a barrel sleeve 42, a barrel support 144 and a collet 46 disposed between in the barrel support 144 for fixedly securing the barrel sleeve 42 therein. A collet nut 48, in the form of a flash hider that has been removed from the service barrel, is threadably received in the barrel support 144 for clamping the collet 46 onto the barrel sleeve 42.

The barrel support 144 is generally cylindrical in shape and sized to replace the muzzle silencer 18 of the weapon 10. With the muzzle silencer 18 removed from the weapon, the barrel support 144 may be inserted into the hand guard 14. A tapered blind bore 150 formed in the barrel support 144 functions as a spindle for receiving the collet 46. The blind bore 150 includes a first cylindrical section 150.1 having a first diameter D1 extending from the muzzle end 152 of the barrel support 144, a first tapered section 150.2 transitioning from the first cylindrical section 150.1 to a second cylindrical section 150.4 having a second diameter D2. A portion of the first cylindrical section 150.1 is threaded for receiving the collet nut 48. A cylindrical bore 154 extends from the breech end 156 of the barrel support 144 into the blind bore 150 and is configured to receive the barrel sleeve 42.

In operation, the collet 46 is placed into the blind bore 150 of the barrel support 144 until the gripping portion 62 abuts the first tapered section 150.2. The barrel sleeve 42 is inserted into the cylindrical bore 154 in the barrel support 144 and passes through the bore 66 in the collet 46 and extends out of the muzzle end 152 of the barrel support 144. The collet nut 48 is then threaded into the first cylindrical section 150.1 and tightened therein to secure the barrel sleeve 42 in the collet 46. As the collet nut 48 is tightened and engages the collet 46, the shoulder portion 64 is urged toward the first tapered section 150.2 thereby causing the inner diameter of the gripping portion 62 to reduce and grip the barrel sleeve 42 at a first clamping point. In this way, the tapered blind bore 150 fixedly secures the barrel sleeve 42 at one end of the collet 46 into the barrel support 144.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A conversion kit for a weapon to replace a service barrel with a training barrel for firing reduced energy training cartridges, the conversion kit comprising:

a barrel support having a tapered bore extending from a muzzle end of the barrel support and a cylindrical bore extending from a breech end of the barrel support and into the tapered bore, wherein the tapered bore has a first cylindrical section, a second cylindrical section and a first tapered section between the first and second cylindrical sections;

a collet including a shoulder disposed in the first cylindrical section and a sleeve portion disposed in the second cylindrical section, wherein a collet bore extends through the collet;

a barrel sleeve disposed through the cylindrical bore of the barrel support and through the collet bore; and a collet nut disposed in the first cylindrical portion of the tapered bore and engaging the collet to clamp the barrel sleeve in the barrel support at the first tapered section.

2. The conversion kit of claim 1 wherein the collet nut engages the collet to urge the shoulder toward the first tapered section for gripping the barrel sleeve at a first clamping point.

3. The conversion kit of claim 2, wherein the collet nut is threadably engaged in a threaded portion of the first cylindrical section.

4. The conversion kit of claim 3, wherein the collet nut is a flash hider.

5. The conversion kit of claim 1, further comprising one or more blind bores formed in the breech end of the barrel support.

6. The conversion kit of claim 1, wherein the collet further comprises a plurality of flutes configured to flex radially inward for gripping the barrel sleeve.

7. The conversion kit of claim 1, wherein the collet comprises one or more longitudinal slots extending from the muzzle end of the collet to define the plurality of flutes.

8. The conversion kit of claim 7, wherein the collet comprises one or more longitudinal slots extending from the breech end of the collet to further define the plurality of flutes.

9. The conversion kit of claim 1, wherein the first cylindrical section has a first diameter and the second cylindrical section has a second diameter less than the first diameter.

10. A conversion kit for a weapon to replace a service barrel with a training barrel for firing reduced energy training cartridges, the conversion kit comprising:

a barrel support having a double tapered bore extending from a muzzle end of the barrel support and a cylindrical bore extending from a breech end of the barrel support and into the double tapered bore, wherein the doubled tapered bore has a first cylindrical section, a second cylindrical section, a first tapered section between the first and second cylindrical sections and a second tapered section disposed at the end of the second cylindrical section opposite the first tapered section;

a collet including a shoulder disposed in the first cylindrical section and a sleeve portion disposed in the second cylindrical section, wherein a collet bore extends through the collet;

a barrel sleeve disposed through the cylindrical bore of the barrel support and through the collet bore; and a collet nut disposed in the first cylindrical portion of the tapered bore and engaging the collet to clamp the barrel sleeve in the barrel support at the first tapered section and at the second tapered section.

11. The conversion kit of claim 10 wherein the collet nut engages the collet to urge the shoulder toward the first tapered section for gripping the barrel sleeve at a first clamping point and to urge the sleeve portion toward the second tapered section for gripping the barrel sleeve at a second clamping point.

12. The conversion kit of claim 11, wherein the collet nut is threadably engaged in a threaded portion of the first cylindrical section.

13. The conversion kit of claim 12, wherein the collet nut is a flash hider.

14. The conversion kit of claim 10, further comprising one or more blind bores formed in the breech end of the barrel support.

15. The conversion kit of claim 10, wherein the collet further comprises a plurality of flutes configured to flex radially inward for gripping the barrel sleeve.

16. The conversion kit of claim 15, wherein the collet comprises one or more longitudinal slots extending from the muzzle end of the collet to define the plurality of flutes.

17. The conversion kit of claim 16, wherein the collet comprises one or more longitudinal slots extending from the breech end of the collet to further define the plurality of flutes.

18. The conversion kit of claim 10, wherein the first cylindrical section has a first diameter and the second cylindrical section has a second diameter less than the first diameter.

19. The conversion kit of claim 18, wherein the barrel sleeve comprises a third cylindrical section extending from the second tapered section having a third diameter less than the second diameter.

20. A method of converting a weapon from firing live ammunition to firing reduced energy training cartridges, the method comprising:

removing a service barrel from a receiver of the weapon;

providing a barrel support having a tapered bore extending from a muzzle end of the barrel support and a cylindrical bore extending from a breech end of the barrel support and into the tapered bore;

sliding a barrel sleeve into the cylindrical bore and through the barrel support;

providing a collet having a collet bore formed therethrough;

sliding the barrel sleeve into the collet bore and through the collet;

inserting the collet into the tapered bore of the barrel support;

providing a collet nut;

sliding the barrel sleeve through the collet nut;

inserting the collet nut into the tapered bore of the barrel sleeve;

engaging the collet nut with the collet in the barrel support to tighten and secure the barrel sleeve to the barrel support; and installing the barrel support onto the receiver.

* * * * *